US008680440B2

(12) United States Patent
Cohen et al.

(10) Patent No.: US 8,680,440 B2
(45) Date of Patent: Mar. 25, 2014

(54) CONTROL CIRCUIT FOR CONTROLLING HEATING ELEMENT POWER

(75) Inventors: Steve M. Cohen, New York, NY (US); Juan D. Bravo, Wingdale, NY (US)

(73) Assignee: T-Ink, Inc., New York, NY (US)

( * ) Notice: Subject to any disclaimer, the term of this patent is extended or adjusted under 35 U.S.C. 154(b) by 1129 days.

(21) Appl. No.: 12/210,799

(22) Filed: Sep. 15, 2008

(65) Prior Publication Data

US 2009/0073732 A1 Mar. 19, 2009

Related U.S. Application Data

(60) Provisional application No. 60/972,370, filed on Sep. 14, 2007.

(51) Int. Cl.
*H05B 3/02* (2006.01)
*G05F 1/00* (2006.01)

(52) U.S. Cl.
USPC ..... 219/486; 323/283

(58) Field of Classification Search
USPC ..... 363/74; 323/282–284, 271, 273, 277; 219/486
See application file for complete search history.

(56) References Cited

U.S. PATENT DOCUMENTS 4,565,918 A 1/1986 Ayabe et al.
4,804,916 A 2/1989 Frank
4,885,523 A 12/1989 Koenck
5,023,430 A 6/1991 Brekkestran et al.
5,032,705 A * 7/1991 Batcheller et al. ..... 219/211
5,105,067 A * 4/1992 Brekkestran et al. ..... 219/497
5,708,256 A * 1/1998 Montagnino et al. ..... 219/497
5,893,991 A * 4/1999 Newell ..... 219/211
6,465,993 B1 10/2002 Clarkin et al.
7,131,187 B2 * 11/2006 Check et al. ..... 29/611
8,008,606 B2 * 8/2011 Kaiserman et al. ..... 219/520
2001/0011585 A1 * 8/2001 Cassidy et al. ..... 165/46
2006/0118549 A1 * 6/2006 Fishman et al. ..... 219/656

OTHER PUBLICATIONS

International Search Report and Written Opinion of the International Searching Authority, PCT/US08/76422, Dec. 2, 2008.

* cited by examiner

*Primary Examiner* — Adolf Berhane
*Assistant Examiner* — Emily P Pham
(74) *Attorney, Agent, or Firm* — Lerner, David, Littenberg, Krumholz & Mentlik, LLP

(57) ABSTRACT

A control circuit and associated method for dynamically controlling power to one or more heating elements are provided. A power source supplies power to a load through one or more current pass elements, which is controlled by a control signal. A processor determines a time period (T) having a time cycle beginning at $T_{on}$ and a Time cycle end at $T_{off}$, where the Time cycle end is less than the time period (T), variable, and generates the control signal or signals each time period (T), thereby electrically connecting the power source to the load and the current sensing element each time period (T) to dispense precisely predetermined quantities of energy per pulse.

16 Claims, 7 Drawing Sheets

| FIG. 6A | FIG. 6B |
|---|---|

CONTROL CIRCUIT FOR CONTROLLING HEATING ELEMENT POWER

CROSS REFERENCE TO RELATED APPLICATIONS

This application claims priority to, and the benefit of, U.S. Provisional Patent Application Ser. No. 60/972,370, filed Sep. 14, 2007, which is hereby incorporated by reference in its entirety.

BACKGROUND OF THE INVENTION

1. Field of the Invention

The subject invention relates to a controller and associated method for controlling electrical power to a heating element.

2. Related Art

Some temperature control systems include a controller, a temperature sensor and a control element such as a resistive heater load. The controller accepts temperature information from the temperature sensor such as a thermocouple or resistance temperature detector (RTD) as input. The actual temperature is compared to a desired control temperature, or setpoint, and the controller provides an output signal to the control element.

In other temperature control systems, thermal feedback is either unavailable or unnecessary because the thermal characteristics of the system are known a priori. In such cases, the use of a closed-loop control system is unnecessary.

BRIEF DESCRIPTION OF THE INVENTION

In one embodiment, a control circuit and associated method for controlling power to a heating element are provided, which include a power source configured to supply power to a load through a current pass element. The current pass element is controlled by a control signal. A processor determines a time period (T) having a time cycle beginning at $T_{on}$ and a Time cycle end at $T_{off}$, where the Time cycle end is less than the time period (T). The processor is further generates the control signal each time period (T), thereby electrically connecting the power source to the load and the current sensing element each time period (T). One time period may be different from other time periods.

Further features and advantages of the present invention as well as the structure and operation of various embodiments of the present invention are described in detail below with reference to the accompanying drawings.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

The present invention is now described in more detail herein in terms of an exemplary controller constructed as an open loop device that generates constant power within a remote load of variable impedance by measuring applied voltage and current drawn and dispensing power in pulse trains of precisely controlled time periods. The controller controls the dissipation or creation of constant heat or mathematically integrated constant power over repetitive equal (or unequal) time periods where the electrical power is applied to a resistive heater load in an environment where thermal feedback is either unavailable or unnecessary because the thermal characteristics of the system are known a priori. The constant heat produces a predictable temperature rise or temperature differential between an ambient temperature and the set point temperature elevation. The electrical load does not necessarily have to possess a purely resistive component, and can also possess inductive and capacitive components.

Figure 1A:
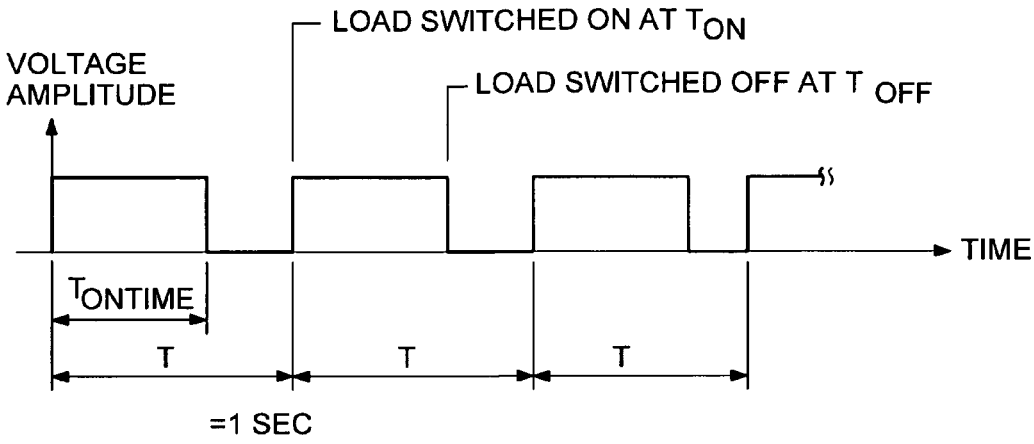
FIG. 1A is a graph showing power being turned on and off to a load in a cyclical nature.

FIG. 1A is a graph showing the output of a controller, particularly showing power being turned on and off to a load in a cyclical nature. As shown in FIG. 1A, the controller dispenses power in discrete time periods T, which can be arbitrarily large or small, and depends upon the application bandwidth requirement and processor computational bandwidth. Within each time period T the load is switched on at $T_{on}$, the beginning of the time cycle, and switched off at $T_{off}$, where $T_{off}$ is equal to or less than T, thus duty cycle modulating the total power to the load within the time period T. In this case, the percent duty cycle equals:

$$((T_{off}-T_{on})/T)\times 100\% \quad (1)$$

Within each time period T, the load is electronically connected to an electrical power source such as a rechargeable or non-rechargeable battery or power supply.

The present embodiment connects the load to a DC power source but the controller can work equally well from an alternating current source or any waveform possessing either or both DC and AC components which can provide electrical power to a load, and this waveform can be evaluated in real time so that an accurate measurement of delivered power can be mathematically calculated and compared to a set point power.

The load can be connected by an electrical pass element or current pass element including, but not limited to, a power Polysilicon Emitter Transistor (PET), junction gate field-effect transistor (JFET), or other transistor, silicon-controlled rectifier (SCR), Triac, vacuum tube, mechanical relay, or a mechanical switch, controlled from a multiplicity of sources including, but not limited to, mechanical mechanisms, pneumatic, optical, magnetic, or other electrical pass element now known or unknown which can pass the necessary current in a manner which can be gated on and off at precise times under mechanical or electronic control using signals such as those created by a microprocessor, digital circuit, analog circuit, or any combination.

The controller measures in real time the output current I and the load voltage V which supplies the current. This enables the instantaneous power $P_i$ to be determined in real time. $P_i$ is only a function of the applied voltage V and the load resistance R, which is unknown or variable. If the set point power $P_{set}$ is less than $P_i$ the pass element can be switched off for part of the time period T, thus dispensing the desired set point power $P_{set}$, and this will affect and create the desired temperature rise in a heater application. The power on time, $T_{ontime}$, is calculated as follows:

$$T_{ontime}=(P_{set}/P_i)T, \quad (2)$$

where $T_{ontime}$=power on time of the power pulse, $P_{set}$=set point power, $P_i$=instantaneous power (e.g., greater than $P_{set}$), and T=time period over which instantaneous power is being integrated, in this case=1 second.

During the next time period T, the entire process is repeated and a new $T_{ontime}$ is calculated. This control technique can be used in battery powered heating systems where the battery voltage is continuously dropping throughout the battery discharge cycle and the power on time can be continuously adjusted to dispense constant integrated power within a resistive load. If the load impedance changes, the instantaneous power changes, and this can likewise be compensated for in real time so constant mathematically integrated power can be maintained. If $P_{set}$ is greater than $P_i$, then the power can remain on continuously. This, however, is outside the controller's range of linear operation. This will happen, for example, if the load resistance is too high, the supply voltage is too low, the set point power is too high for the system to provide, or some combination of any or all of the above.

Figure 1B:
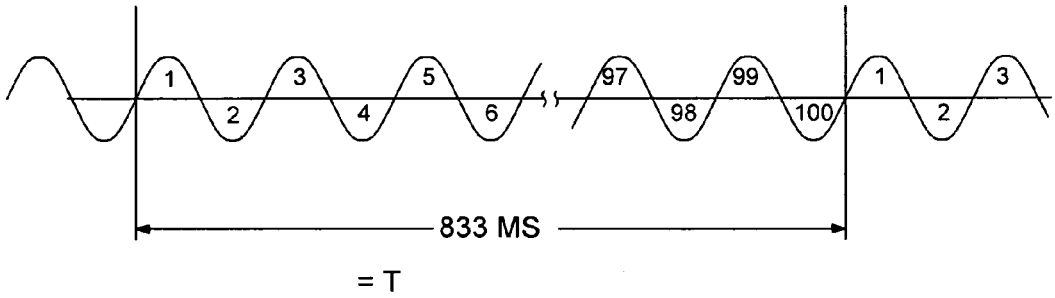
FIG. 1B is a graph showing a 60 Hz AC waveform with a 100% duty cycle.

FIG. 1B is a graph showing the output of a controller, particularly showing a 60 Hz AC waveform with a 100% duty cycle output. As shown in FIG. 1B, the waveform can be switch on and off in discrete half wave increments. For example, 50 cycles of a 60 cycle waveform would represent 100 half wave pulses, and corresponds to 833 milliseconds of time. If a 3% duty cycle were to be applied to a load, three of every 100 half wave pulses would be gated on at the zero crossings. A 99% duty cycle would allow 99 half wave pulses to pass to the load, and so on.

Figure 1C:
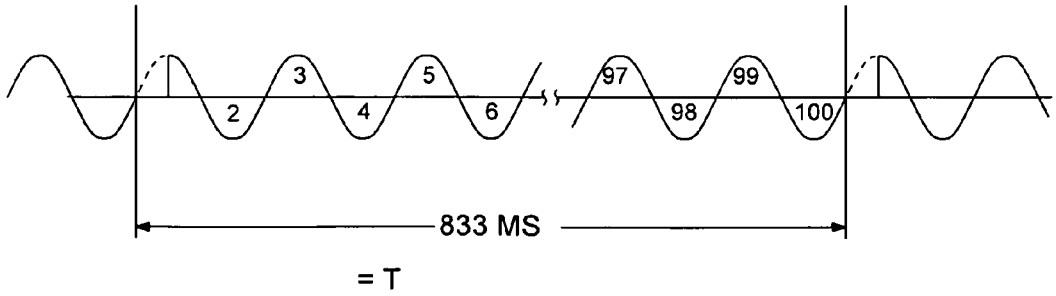
FIG. 1C is a graph showing the 60 Hz AC waveform with a 99.5% duty cycle.

Any arbitrary resolution could be achieved. As shown in FIG. 1C, for example, a 60 Hz AC waveform with a 99.5% duty cycle could be generated. In this figure the first power pulse is gated on during the middle of the pulse, so if a 3.5% duty cycle were desired, the first pulse could be gated on at the 90 degree phase angle and three full half wave pulses would be completely gated thereafter. Alternatively, the first three complete half wave pulses could be gated and the fourth pulse could be gated at the 270 degree phase angle until the next zero crossing.

In one embodiment, a Triac can be used as the current pass element in a manner similar to standard dimmer applications, but the pass element can be any device of sufficient current capable possessing the necessary gating control speed. Power can be calculated and accumulated at any time resolution the bandwidth of the processor is capable of handling, and numerous strategies can enable power to be dispensed including but not limited to gating pulses at the beginning or end of the time period, spreading the pulses throughout the time period, energizing the waveform at zero crossings or at any phase angle during any cycle within the designation of a time period within which power is to mathematically integrated.

The voltage and current could be evaluated and sampled during every pulse and the power integrated until the set point power is reached. Excess power or power deficits in one period can be made up for in subsequent time periods by application of extra pulses or on time or by subtraction of extra pulses or on time. Since heat can be a slowly integrating quantity, the proper heat and power setting can be spread over time so the net average hovers about the set point power.

Figure 2:
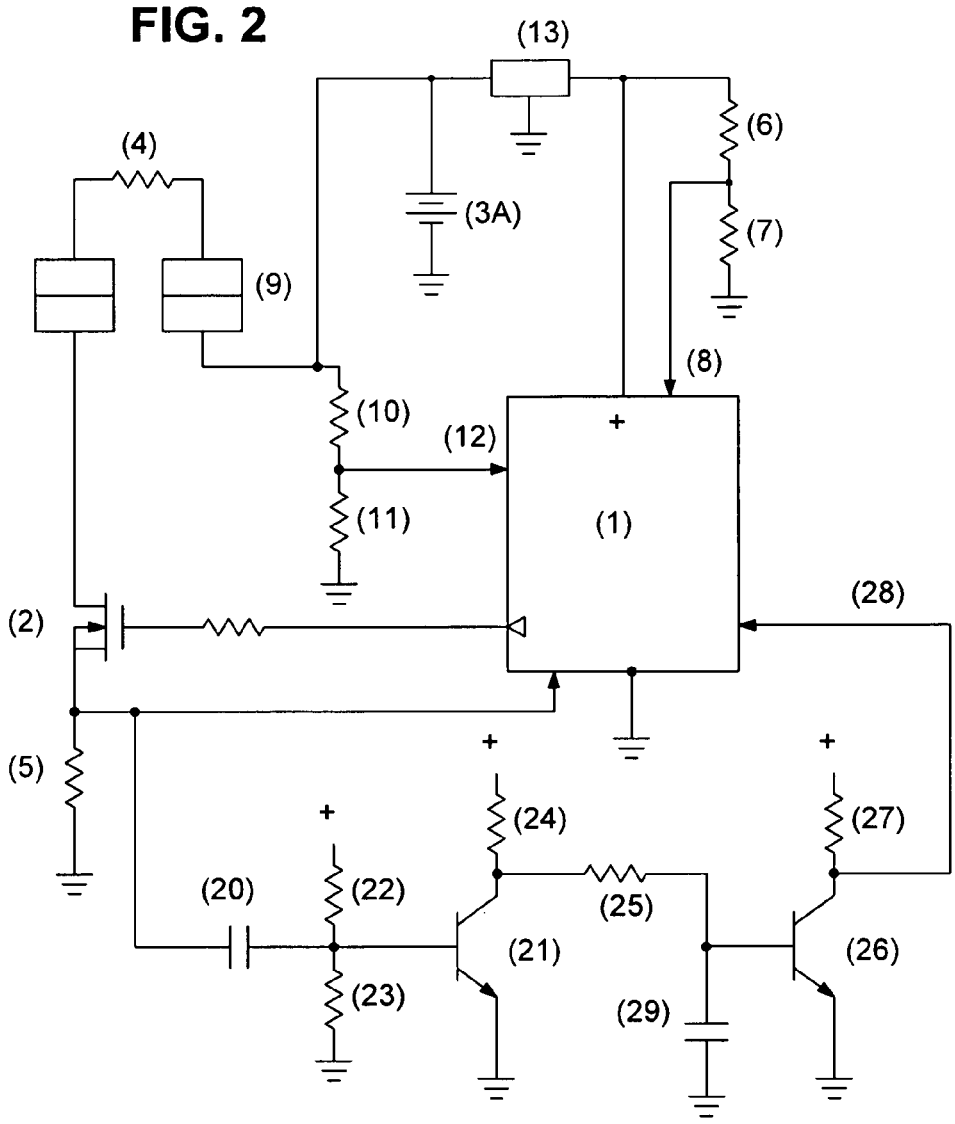
FIG. 2 is an electrical schematic of a control circuit of the present invention showing a microprocessor and associated interconnections.
Figure 3:
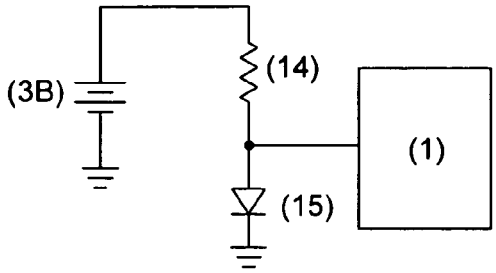
FIG. 3 is an electrical schematic showing an alternative technique of reference voltage generation.

Referring to FIG. 2, microprocessor (1) applies gate voltage to FET (2) which enables current to flow from a battery (3A) into a heat producing load resistor (4) and a current sense resistor (5). The current sense resistor voltage is measured by an A/D converter (not shown) within the microprocessor. The A/D converter can be either external or internal to the microprocessor, but for convenience and cost in this embodiment, a microprocessor including an internal A/D converter with channel select was chosen to accommodate multiple analog inputs. The A/D reference voltage can either be internally generated within the microprocessor or externally generated, and can be generated in any number of ways including but not limited to the two methods shown in FIGS. 2 and 3. A reference voltage is generated by the voltage divider formed by resistor (6) and (7), the center tap (8) of which is fed back to the microprocessor. The processor power is generated using an on board voltage regulator (13) which takes the input supply voltage from the battery (3A) and regulates it to a constant voltage to power the microprocessor and other circuitry necessary to measure the dynamic state of the load. This method can be implemented with higher battery voltages such as those created by connecting one or more battery cells in series. Alternatively, a reference voltage generator for lower voltage single battery cell systems can be constructed as shown in FIG. 3, particularly formed by resistor (14) and signal diode or Zener diode (15) powered from battery (3B).

The current sense resistor (5) is chosen to be low enough in resistance so as not to dissipate unnecessary power while simultaneously generating enough voltage for the A/D converter to quantify with sufficient resolution for an application-specific appropriate resolution control of the output duty cycle and power-on time. The voltage of the output pulse is measured at the positive output terminal (9) via the voltage divider formed by resistors (10) and (11), the center tap (12) of which is fed back to the microprocessor for A/D quantification and subsequent calculation.

Delay of Current and Voltage Measurement

The time at which current and voltage are measured and quantified by the A/D converter can be controlled to provide maximum accuracy of the average value of these parameters. As is sometimes the case with a conductive medium which is used to produce heat, sometimes the impedance can change as a function of current on-time and temperature of the heat-producing medium. By delaying the measurement of current and voltage, a more accurate average impedance over the time T can be assessed in a DC powered system. This measurement preferably is made prior to the shortest possible pulse the controller would generate.

In an AC powered system, a more complicated sampling of the variable voltage and current is necessary to enable accurate integration and calculation of power.

Maximum Current Detect

While some battery technologies possess built-in short circuit protection which automatically disconnects the battery from its load, it may be desirable to detect an excess current condition under software or hardware control and disable the current pass element to prevent excess instantaneous power generation.

In order to prevent an over-current condition which may be detrimental to a battery or power supply, electronics, garment, or system, the program can quickly turn off the output pass element. This can happen as quickly as it takes to perform the A/D conversion of current and compare under program control whether the current is above, equal to, or below a preset threshold value.

This can also be done in a completely analog manner by sensing voltage levels in a manner including but not limited to voltage comparators, the biasing and switching of any number of semiconductor elements which can, with circuitry, disable the output current pass element, and these can either be latching or resetable circuits under program or manual control.

In one embodiment of the controller used for heating garments, there can be multiple heat settings including but not limited to three: LOW, MEDIUM, and HIGH. Each heat setting corresponds to a different $P_{set}$ value:

LOW=$P_{set}$ low;

MEDIUM=$P_{set}$ medium; and

HIGH=$P_{set}$ high.

In this embodiment used for garment heating applications, there is also an accelerated transient heating mode to raise the temperature more quickly than the steady state heat setting would, and this accelerated $P_{set}$ value=$P_{set}$ acc.

Accelerated transient heating occurs during the first power up, during a cold start, when the controller is first turned on. After the accelerated transient warm-up period, the steady state set point power initiates, replacing $P_{set}$ acc, and constant power (and corresponding temperature) will be maintained at the $P_{set}$ value chosen by the operator.

When raising set point power from a lower power level to a higher power level, the controller again enters the accelerated transient heating mode for a known or dynamically calculated period of time, after which the steady state $P_{set}$ power for the new setting will be maintained.

When lowering the set point power from a higher power level to a lower power level, the controller will discontinue output pulses for a predetermined or dynamically calculated period of time, after which the steady state $P_{set}$ power for the new setting will be maintained. The dynamic calculation can be based on an inferred calculated temperature, a new set point temperature, and garment or system thermal properties.

One embodiment of the constant power controller is used to control the heat generated in garments, blankets, and fabrics including but not limited to heated jackets, vests, back warmers, selected zone heating in fabrics, hats, gloves, hand warmers, scarves, socks, and boots. For simplicity, all of the above will be referred to as simply garments.

There are three heat settings in one particular embodiment: LOW, MEDIUM, and HIGH. When the controller is first turned on and the garment is assumed to be cold, the controller dispenses power $P_{set}$ acc in an accelerated power mode for three possible predetermined periods of time corresponding to the conditions outlined below:

1) from cold to LOW;
2) from cold to MEDIUM; and
3) from cold to HIGH.

Once steady state has been reached for any of these three settings, the controller under operator control can be instructed to go from any setting to any other setting as follows:

4) LOW to LOW;
5) LOW to MEDIUM;
6) LOW to HIGH;
7) MEDIUM to LOW;
8) MEDIUM to MEDIUM;
9) MEDIUM to HIGH;
10) HIGH to LOW;
11) HIGH to MEDIUM; and
12) HIGH to HIGH.

As can be seen there are nine possible states to go from any $P_{set}$ power level to any other $P_{set}$ power level. Three of these power transitions involve a power increase transition as follows:

5) from LOW to MEDIUM;
6) from LOW to HIGH; and
9) from MEDIUM to HIGH.

Including the three cold start conditions, six conditions (1, 2, 3, 5, 6, and 9) all involve an accelerated power increase setting for a time period predetermined and based upon the physical thermal heat transfer characteristics of the garment.

The following three conditions involve accelerated power decrease:

7) from MEDIUM to LOW;
10) from HIGH to LOW; and
11) from HIGH to MEDIUM.

In these conditions (7, 10 and 11), the power is turned off for corresponding predetermined periods of time so heat and corresponding temperature can dissipate due to normal heat transfer to the outside environment. Turning the power off is the fastest way to drop the temperature.

There are also three conditions in which no action is taken, when the controller is asked to go from an existing heat setting to the same setting. These are:

4) from LOW to LOW;
8) from MEDIUM to MEDIUM; and
12) from HIGH to HIGH.

So in the above embodiment there are twelve possible heat change conditions to be considered, six of which involve accelerated power increase, three of which involve accelerated power decrease, and three involving no change.

There are also embodiments of the controller where there are no preset values of any factory settings, and in this case the user has control of the power in incremental values to either increase or decrease $P_{set}$ power for finer thermal control resolution. In this case it is possible to calculate the time to achieve target temperature based on (known heat added−inferred heat lost). If more heat is lost than added the temperature will drop until steady state is reached. If more heat is added than lost, the temperature will rise until steady state is reached.

Multiple Channels

Figure 4:
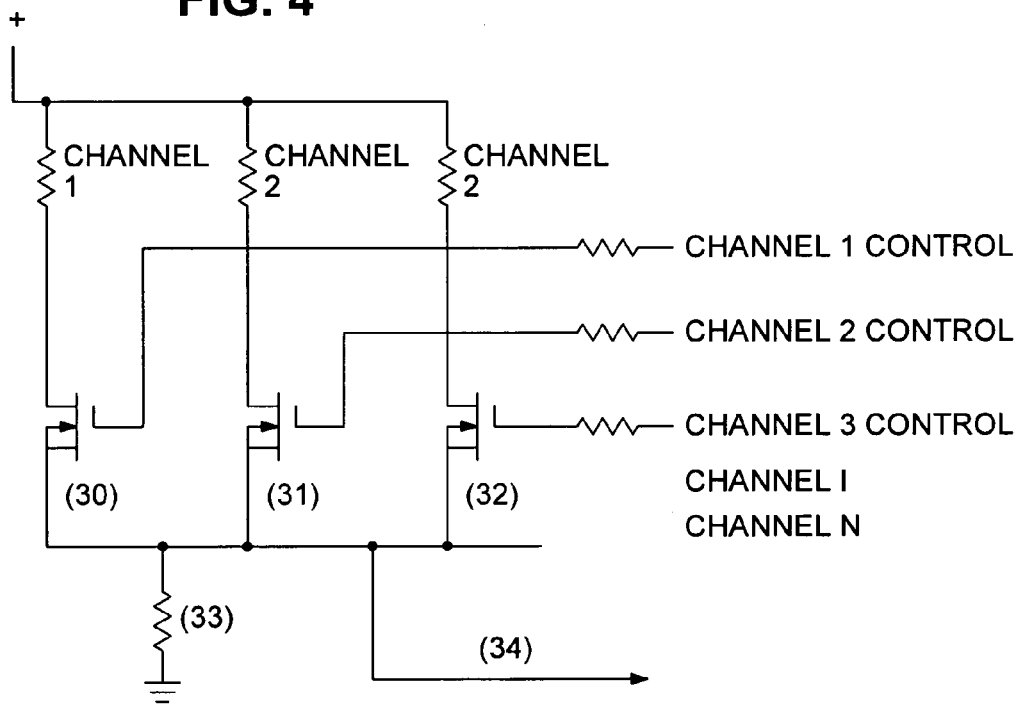
FIG. 4 is an electrical schematic showing multiple pass elements with electrically connected to a common current sense resistor.

It is possible for any number of channels to be processed using the same control strategy. FIG. 4 is an electrical schematic showing exemplary multiple pass elements electrically connected to a common current sense resistor. As shown in FIG. 4, if current supply from a battery or other power source permits only one channel of output current, it is possible to switch multiple pass elements (30), (31), and (32) connected in common to the same current sense resistor (33). In this manner it is possible to measure the current (34) through channel 1 when channel 1 is energized by pass element (30), then when channel 1 is turned off, channel 2 is energized by pass element (31) and the current for channel 2 is measured using the same current sense resistor, and so on.

Safety: Redundant Pass Elements

Figure 5:
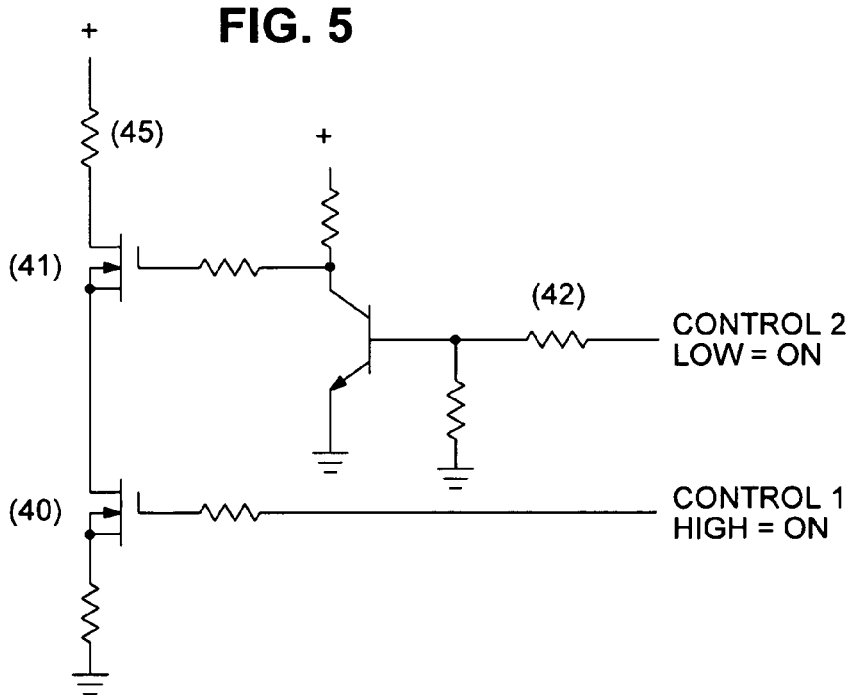
FIG. 5 is an electrical schematic showing two pass elements connected in series and triggered by opposite logic levels.

FIG. 5 is an exemplary electrical schematic showing two pass elements connected in series and triggered by opposite logic levels. As shown in FIG. 5, because it is possible for pass elements to fail in a shorted condition, two pass elements can be placed in series where cost permits or safety demands. In this series configuration, one pass element (40) can be triggered from a logic high signal, and the other pass element (41) can be triggered from a logic low, where the logic low can either directly energize the pass element, if an active low device is employed such as but not limited to a PNP transistor, or may result from inversion created by external circuitry such as but not limited to (42) such that the controlling device (such as a microprocessor) simultaneously outputs a logic high on one port and logic low on another port to connect power to the load (45). The logic behind this is that a microprocessor may fail with all ports high or all ports low, but the probability of one port failing high and one port failing low is extremely small, and with it correspondingly increased safety.

Safety: Flame Sensor

Because the current sense line provides a voltage that is proportional to the current, it is possible to detect not only the DC component of the current but a high frequency AC components also. The AC component contains information about the structural integrity of the heating element, and the onset of a failure is electronically detectable in the form of electrical noise.

When a filament or heating element composed of wire, conductive tape, conductive elements, or conductive ink is about to fail, arcing at hot spots is often generated in the vicinity of high current density at the impending failure site. The resultant arcing produces an AC signature of electrical noise which can be detected either using an analog circuit or by passing through an A/D converter and digitally processing. Referring again to FIG. 2, a representative analog circuit is shown and composed of decoupling capacitor (20), sufficiently-high beta transistor (21) and pull-up resistor (24), bias resistors (22) and (23), a filter formed by resistor (25) and capacitor (29), transistor (26) and pull-up resistor (27). The collector output of transistor (26) is fed back (28) to the microprocessor as an input which can be used to process information about the integrity of the current drawing heating element. The input can either be used to interrupt the microprocessor or it can be detected by polling the inputs at sufficient bandwidth. The circuit shown is only one of many implementations for amplification of an AC signal, and other methods include but are not limited to high pass filtering and amplification using both discrete and/or integrated linear and/or non-linear components.

There are many criteria that can be used to determine the impending failure of a conductive trace. One method is to simply count pulses per unit time, and if this value exceeds a threshold then the condition is met and action will be taken. This is useful for eliminating false positives due to static discharge which can trigger the flame sensor in very dry environments. Pulses are not accumulated when power is first applied to the heating element or when power is disconnected because these transitions also produce an AC pulse that would otherwise be accumulated as a potential flame onset condition. The flame sensor is valid only during the steady state on time of a power producing pulse. If static pulses are generated during a current off time they will not be accidentally accumulated and processed as a potential impending heater failure.

If the flame sensing condition is considered positive, the controller enters a mode where current is not permitted to be sent to the heater or heaters in question. This can prevent excess temperature generation at a failure zone.

The controller can have lights or audio cues to indicate heat settings and the various failure modes including but not limited to:

LOW mode;
MEDIUM mode;
HIGH mode;
POWER UP;
POWER DOWN;
OVER-CURRENT CONDITION;
OPEN CIRCUIT CONDITION; and
FLAME SENSING CONDITION DETECTED.

The controller can be shut off by resetting the processor with an off button or hardware reset. The controller can also shut off if the battery is completely exhausted and voltage ceases to power the processor.

In controller embodiments where rechargeable batteries are provided with the controller or contained within the controller box, a charging system can be provided by connecting the controller to an external charger. The charging system can either be internal or external to the controller depending upon economics or product requirements.

External batteries or power can also be used to augment or extend power beyond the life of an internal individual battery or to increase power to the heater.

Figure 6A:
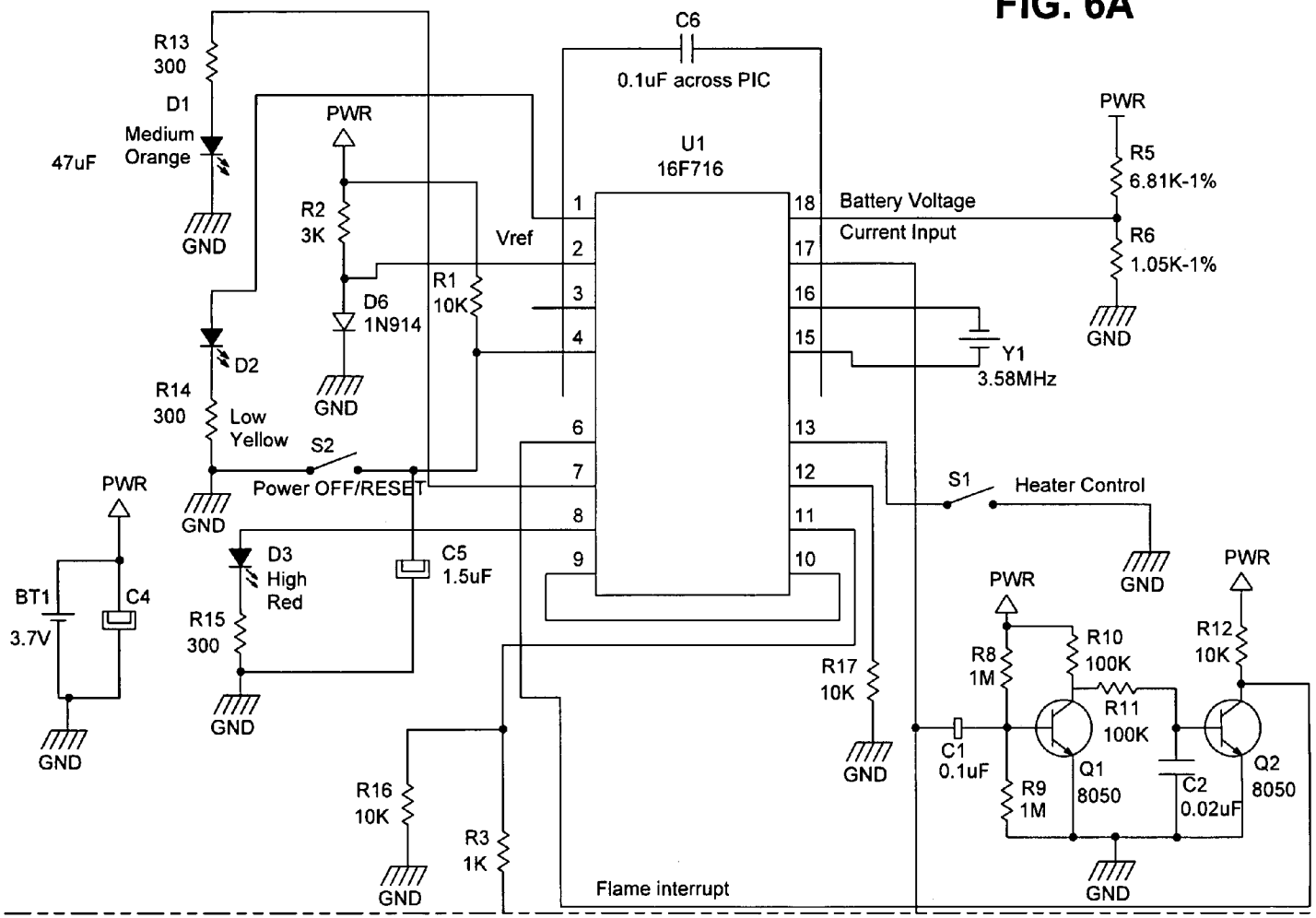
FIG. 6 is an electrical schematic of the control circuit for an embodiment utilizing a heater powered by a single battery.
Figures 6, 6B:
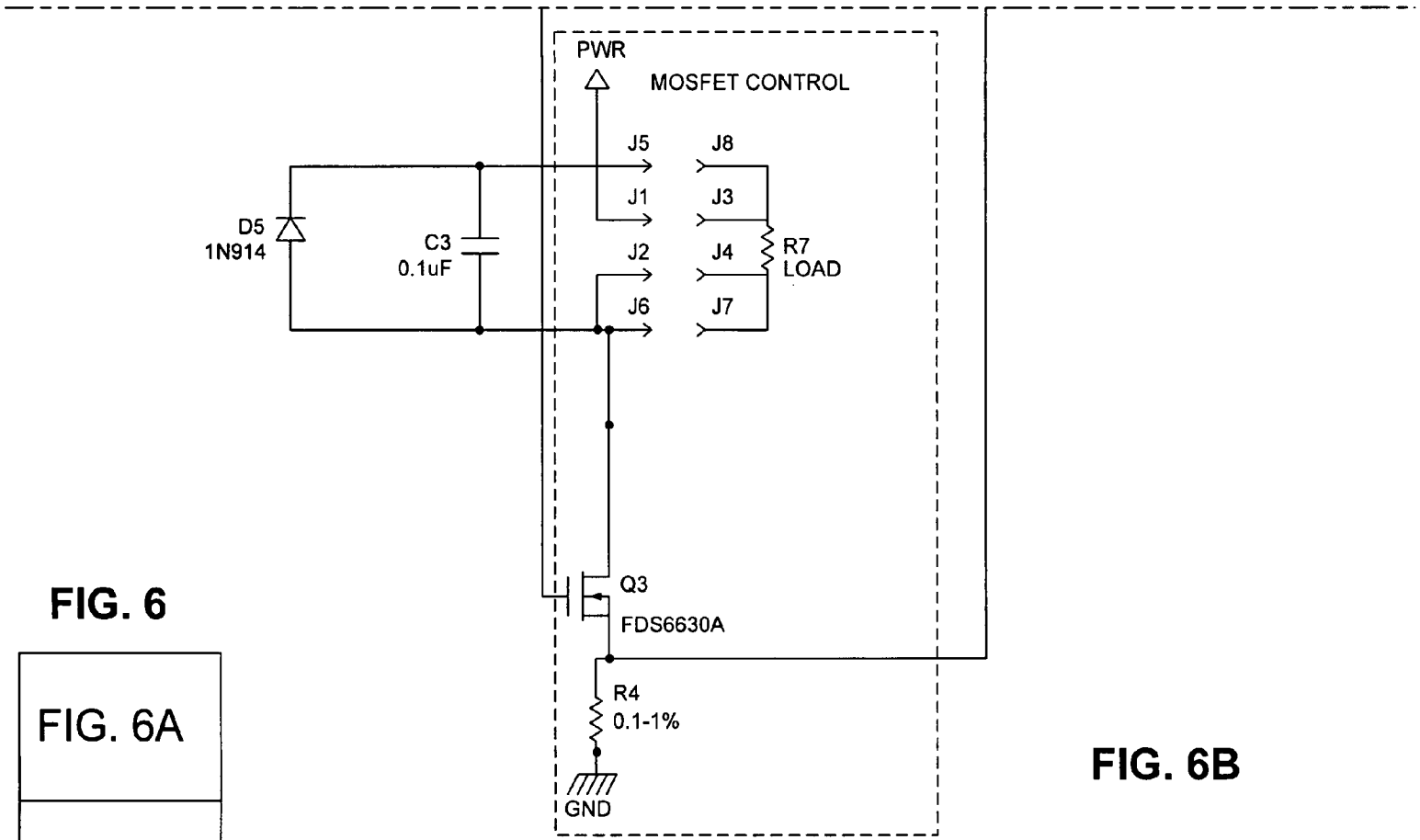
Figure 7A:
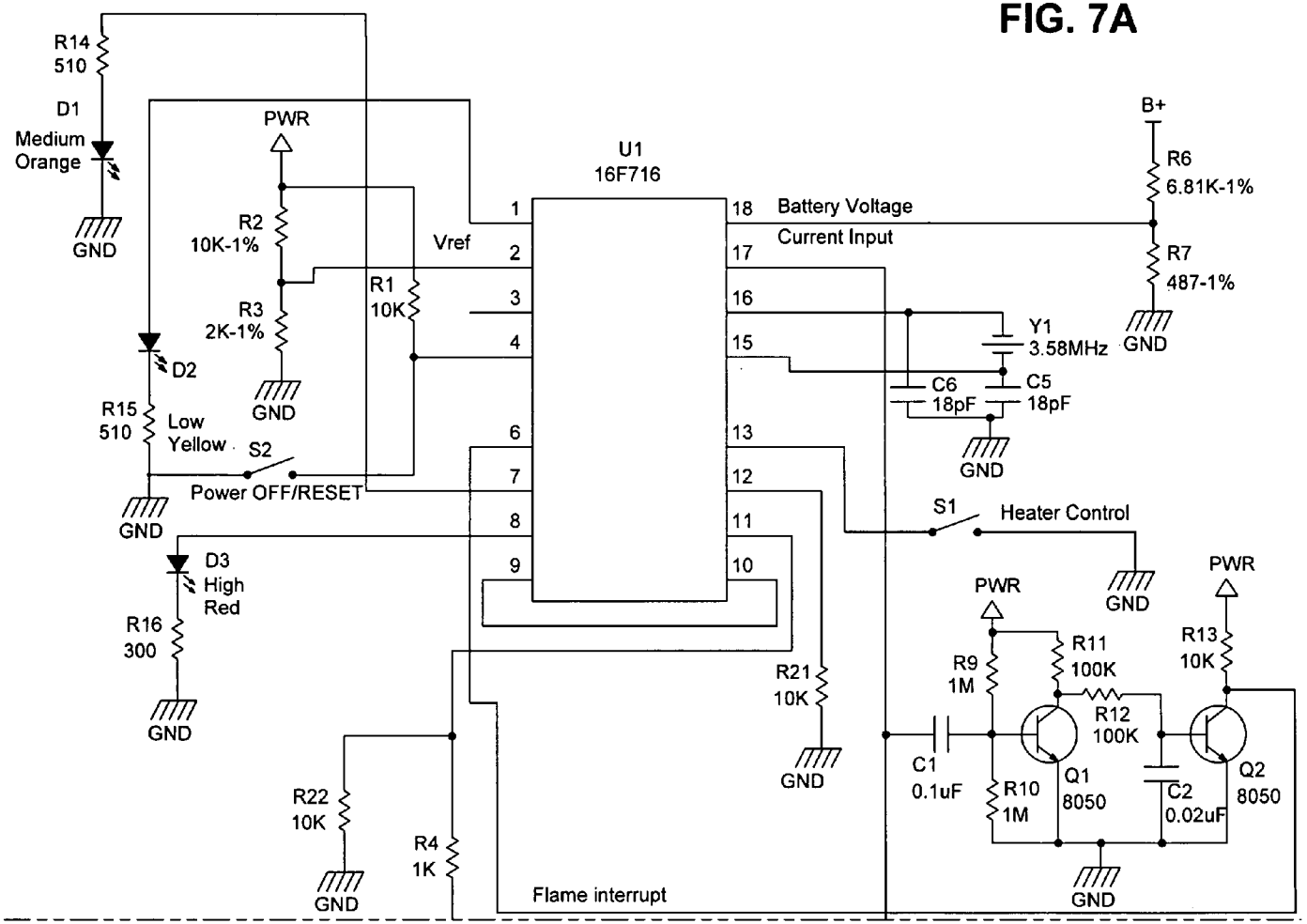
FIG. 7 is an electrical schematic of the control circuit for an embodiment utilizing a heater for a wearable garment.
Figures 7, 7B:
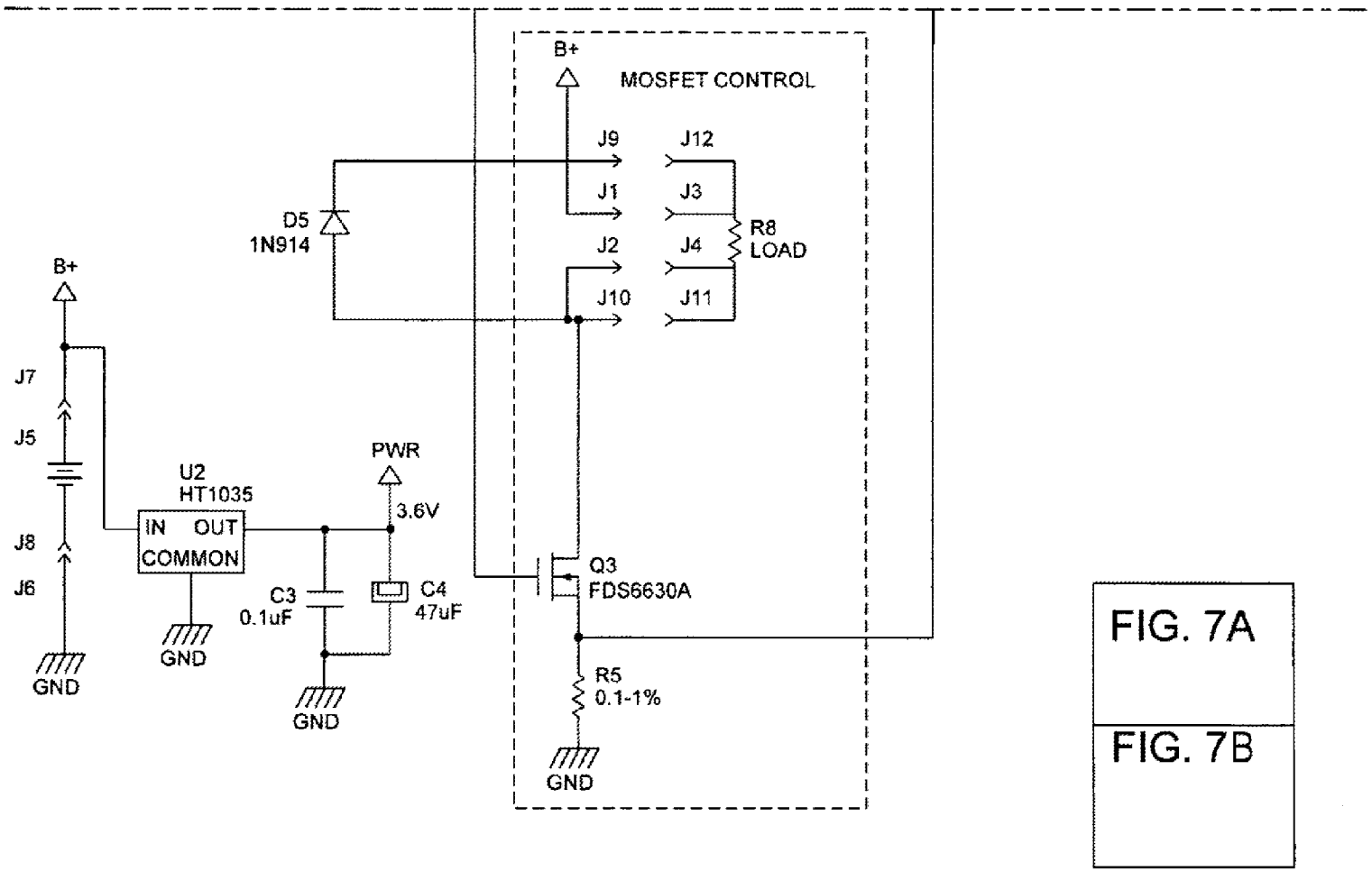

FIG. 6 is an electrical schematic of the control circuit for an embodiment utilizing a heater powered by a single battery and FIG. 7 is an electrical schematic of the control circuit for an embodiment utilizing a heater for a wearable garment. Both control circuits show particular values for the corresponding components described above with respect to FIGS. 2-4. It should be understood that the precise values of the various components are a design choice. In particular, the relationship between the components in FIGS. 2, 6 and 7 are as follows:

| FIG. 2 | FIG. 6A, B | FIG. 7A, B | |
|---|---|---|---|
| (5) | R4 | R5 | Current sense resistor |
| (2) | Q3 | Q3 | Current pass element FET |
| (4) | R7 | R8 | Load heater |
| (10), (11) | R5, R6 | R6, R7 | Batter voltage input to processor |
| (6), (7) | R2, D6 | R2, R3 | A/D converter reference voltage |
| (20) | C1 | C1 AC | noise decoupling element for flame sensor |
| (22), (23) | R8, R9 | R9, R10 | sets bias voltage for transistor base |
| (21) | Q1 | Q1 | First gain stage for flame sensor |
| (24) | R10 | R11 | Pull up resistor |
| (25), (29) | R11, C2 | R12, C2 | filter for flame interrupt pulse lengthening |
| (26) | Q2 | Q2 | flame sensor second stage |
| (27) | R12 | R13 | pull up resistor for second stage transistor |
| (28) | U1, pin 6 | U1, pin 6 | flame sensor interrupt to processor |
| (13) | | U2 | voltage regulator for voltages larger than one cell |
| (3A) | BT1 | B+ | battery in FIG. 6 or batteries in FIG. 7 |
| | R3 | R4 | FET gate drive from U1 pin 11 |
| | R16 | R22 | FET gate pull down |
| | D2 | D2 | low indicator LED |

-continued

| FIG. 2 | FIG. 6A, B | FIG. 7A, B | |
|---|---|---|---|
| | R14 | R15 | current limit resistor |
| | D1 | D1 | medium indicator LED |
| | R13 | R14 | current limit resistor |
| | D3 | D3 | high indicator LED |
| | R15 | R16 | current limit resistor |

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A control circuit for controlling power to a heating element to control heat in a garment, the control circuit comprising:

a power source configured to supply power to a load through a current pass element, the current pass element controlled by a control signal;

a memory configured to store a discharge characteristic of the power source;

a processor configured to determine a time period (T) having a time cycle beginning at Ton and a Time cycle end at Toff, where the Time cycle end is less than the time period (T), to generate the control signal each time period (T), thereby electrically connecting the power source to the load and the current pass element each time period (T);

a current measuring device configured to measure an output current; and a voltage measuring device configured to measure a load voltage, wherein the processor is further configured to calculate an instantaneous power (Pi) based on the output current and the load voltage and to modify the power on time (Tontime) based on an elapsed time the garment has been operating and on the discharge characteristic and a thermal property of the garment.

2. The control circuit according to claim 1, further comprising:

the processor further configured to calculate a power on time ($T_{ontime}$) based on a predetermined set point power ($P_{set}$), the instantaneous power ($P_i$) and the time period (T), wherein $T_{ontime}=(P_{set}/P_i)T$, and to cause the control signal to connect the power source to the load during the power on time ($T_{ontime}$).

3. The control circuit according to claim 1, further comprising:

a voltage measuring device configured to measure the load voltage; and the processor further configured to modify the pulse width of the control signal to maintain a constant supply power to the load based only on the load voltage.

4. The control circuit according to claim 1, wherein the load is the heating element.

5. The control circuit according to claim 1, wherein the predetermined set point power ($P_{set}$) is replaced by another set point power ($P_{set_acc}$) to increase the amount of power supplied to the load.

6. The control circuit according to claim 1, further comprising:

an alternating current (AC) component detector configured to detect an AC component generated by the load.

7. The control circuit according to claim 6, further comprising:

an interrupt signal generator configured to generate an interrupt signal when the AC component detector detects the AC component, wherein the processor is further configured to perform an interrupt service routine upon receiving the interrupt signal.

8. The control circuit according to claim 6, further comprising:

a signal conditioner configured to convert the AC component to a direct current (DC) signal; and the processor further constructed to receive the DC signal and determine a signature of the AC component based on the DC signal and to manage the control signal based on the signature.

9. A method of controlling power to a heating element to control heat in a garment, the method comprising:

supplying power from a power source to a load through a current pass element, the current pass element controlled by a control signal;

storing a discharge characteristic of the power source;

determining a time period T having a time cycle beginning (Ton) and a Time cycle end (Toff), where the Time cycle end is I less than the time period (T);

generating the control signal each time period (T), thereby electrically connecting the power source to the load and the current sensing pass element each time period (T);

measuring an output current;

measuring a load voltage;

calculating an instantaneous power (Pi) based on the output current and the load voltage; and modifying the power on time (Tontime) based on an elapsed time the garment has been operating and on the discharge characteristic and a thermal property of the garment.

10. The method according to claim 9, further comprising:

calculating a power on time ($T_{ontime}$) based on a predetermined set point power ($P_{set}$), the instantaneous power ($P_i$) and the time period (T), wherein $T_{ontime}=(P_{set}/P_i)T$;

generating the control signal based on the power on time ($T_{ontime}$); and supplying the power to the load during the power on time ($T_{ontime}$).

11. The method according to claim 9, wherein the load is the heating element.

12. The method according to claim 9, further comprising:

replacing the predetermined set point power ($P_{set}$) by another set point power ($P_{set_acc}$) to increase the amount of power supplied to the load.

13. The method according to claim 9, further comprising:

measuring the load voltage; and modifying the pulse width of the control signal to maintain a constant supply power to the load.

14. The method according to claim 9, further comprising:

detecting an alternating current (AC) component generated by the load.

15. The method according to claim 14, further comprising:

generating an interrupt signal when the AC component is detected by the detecting; and performing an interrupt service routine upon receiving the interrupt signal.

16. The method according to claim 14, further comprising:

converting the AC component to a direct current (DC) signal;

determining a signature of the AC component based on the DC signal; and managing the control signal based on the signature.

* * * * *